US006940006B2

(12) United States Patent
Takegawa

(10) Patent No.: US 6,940,006 B2
(45) Date of Patent: Sep. 6, 2005

(54) REVERSIBLE SEAT CUP FOR PERCUSSION INSTRUMENT

(75) Inventor: Akito Takegawa, Yachiyo (JP)

(73) Assignee: Pearl Musical Instrument Co., Chiba (JP)

( * ) Notice: Subject to any disclaimer, the term of this patent is extended or adjusted under 35 U.S.C. 154(b) by 5 days.

(21) Appl. No.: 10/730,080

(22) Filed: Dec. 9, 2003

(65) Prior Publication Data

US 2005/0120864 A1 Jun. 9, 2005

(51) Int. Cl.[7] ..... G10D 3/00
(52) U.S. Cl. ..... 84/327; 84/421; 84/422.3; 84/422.2
(58) Field of Search ..... 84/327, 421, 422.3, 84/422.2; 224/265

(56) References Cited

U.S. PATENT DOCUMENTS 1,607,769 A * 11/1926 Meyer ..... 248/635
2,163,949 A 6/1939 Kiemle ..... 84/402
3,705,528 A * 12/1972 Cordes ..... 84/421
4,122,750 A * 10/1978 Rinker ..... 84/421
4,216,695 A 8/1980 Hoshino ..... 84/421
4,605,144 A 8/1986 LaFlame ..... 224/265
5,934,629 A * 8/1999 Peritz ..... 248/177.1
5,969,381 A * 10/1999 Zenke ..... 257/308
6,054,645 A * 4/2000 Gauger ..... 84/422.3
6,057,500 A 5/2000 Liao ..... 84/422.3

FOREIGN PATENT DOCUMENTS

DE 31 44 302 A1 5/1983

* cited by examiner

*Primary Examiner*—Shih-Yung Hsieh
(74) *Attorney, Agent, or Firm*—Beremato, White & Stavish

(57) ABSTRACT

A reversible seat cup allows free floating or fixed positioning of the seat cup, depending on application. For applications where the cymbal needs to be rigidly held, such as China cymbals, and/or minimal stand noise is essential, such as symphonic performances or studio applications, the seat cup can be positioned with the convex side positioned downward and "locked" firmly to the threaded post. A rubber O-ring on the threaded post fits into a receptacle in the seat cup to provide secure attachment and silent action. For applications where the cymbal, such as crash cymbals, needs freedom of movement, the seat cup can be positioned with the convex side positioned upward. A cavity on the opposite side allows the seat cup to float on the rubber O-ring for optimal cymbal sound. The plastic-type material of the seat cup and the rubber O-ring provides silent action and freedom of motion.

16 Claims, 4 Drawing Sheets

REVERSIBLE SEAT CUP FOR PERCUSSION INSTRUMENT

FIELD OF THE INVENTION

The invention relates to musical instruments of the percussion type and more particularly involves a novel fastener for mounting a cymbal or similar device onto a drum or other suitable support.

DESCRIPTION OF RELATED ART

The general arrangement for mounting a cymbal onto a drum or other suitable support includes a rod or post which terminates at its upper extremity in a reduced threaded end portion over which the cymbal is fitted and secured in place by a washer and wing nut or other suitable fastening and retaining means.

In a typical mounting arrangement, a washer-like rounded metal disc or cup is fitted against a small shoulder on the rod. A felt washer or pad rests on the cup. The rod is covered by a rubber or plastic sleeve. The central hole of the cymbal is fitted over the rod around the sleeve, and the cymbal rests above the felt pad, supported by the metal cup. A rubber or leather spacing washer is positioned over the rod above the cymbal, and a wing nut is screwed down against the spacing washer.

There are two basic seat cup designs. A concave-shaped metal washer provides a platform onto which a cymbal rests. Typically the metal washer is free floating that allows it to follow the tilt of the cymbal and allow the cymbal to "breathe." However metal-to-metal contact between the washer and the threaded post often causes rattling that can be especially bothersome in the recording studio. To minimize rattling, the washer needs to be immobilized. This is accomplished by pushing the sleeve against the washer by tightening the wingnut.

FIG. 1 shows a conventional seat cup arrangement featuring metal seat cup 1, separate sleeve 2, felt members 3 and wingnut 4 which are mounted to a threaded post 5. A variation of the design of FIG. 1 is shown in FIG. 2, whereby the wingnut 4' is provided with an integrated sleeve 2' that when tightened holds the metal seat cup 1' firmly to prevent rattling. See FIG. 2.

In alternate seat cup design, a one-piece plastic washer with integrated sleeve is provided. This alternate design is a molded nylon or plastic seat cup that combines the washer and sleeve into one unit. With no metal-to-metal contact, this type of seat cup is quieter than separate metal washers. However, this design is not free floating and can inhibit the motion of the cymbal and choke the sound of the cymbals that require freedom of motion, such as crash cymbals. See FIG. 3.

Sometimes a musician may want to play a cymbal in a loose mode to produce a reverberating sound with the cymbal held freely and loosely by the fastener. Other times the musician may prefer to play the cymbal in a mute or choked mode to produce a muted sound with the cymbal tightly clamped by screwing the wing nut tightly to the stand.

The need exists for a novel cymbal seat cup that facilitates floating or fixed position depending on the drummer preference or application.

SUMMARY OF THE INVENTION

The invention is a one-piece reversible cymbal seat cup and fastener arrangement that uniquely combines the advantages of both the selective playing mode option of the standard arrangements and a greater convenience when compared to the seat cups disclosed in the prior art.

The invention comprises a reversible seat cup for mounting a cymbal or like instrument to a cymbal stand or other suitable support.

The reversible seat cup allows free floating or fixed positioning of the seat cup, depending on application. For applications where the cymbal needs to be rigidly held, such as China cymbals, and/or minimal stand noise is essential, such as symphonic performances or studio applications, the seat cup can be positioned with the convex side positioned downward and "locked" firmly to the threaded post. A rubber O-ring on the threaded post fits into a receptacle in the seat cup to provide secure attachment and silent action. For applications where the cymbal, such as crash cymbals, needs freedom of movement, the seat cup can be positioned with the convex side positioned upward. A cavity on the opposite side allows the seat cup to float on the rubber O-ring for optimal cymbal sound. The plastic-type material of the seat cup and the rubber O-ring provides silent action and freedom of motion.

Some of the many objects, features and advantages of the invention will become apparent from the detailed description of a preferred embodiment of the invention, set out by way of example, with reference to the accompanying drawings, in which:

DETAILED DESCRIPTION OF PREFERRED EMBODIMENT

Figure 1:
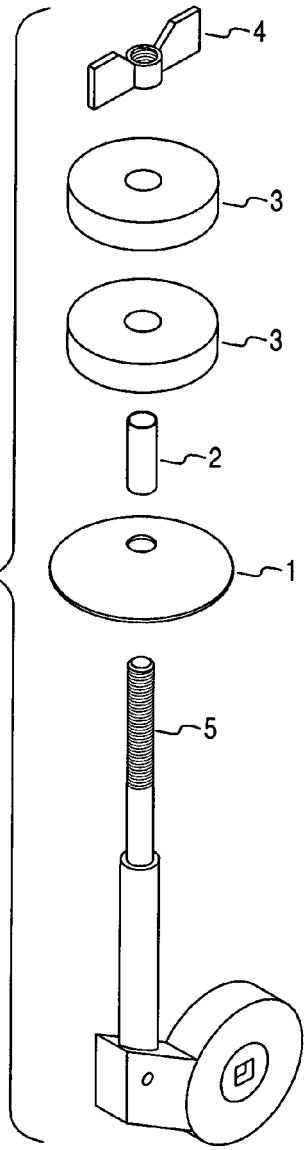
Fig. 1 Prior Art
FIG. 1 is a conventional arrangement for a seat cup with a separate sleeve.
Figure 2:
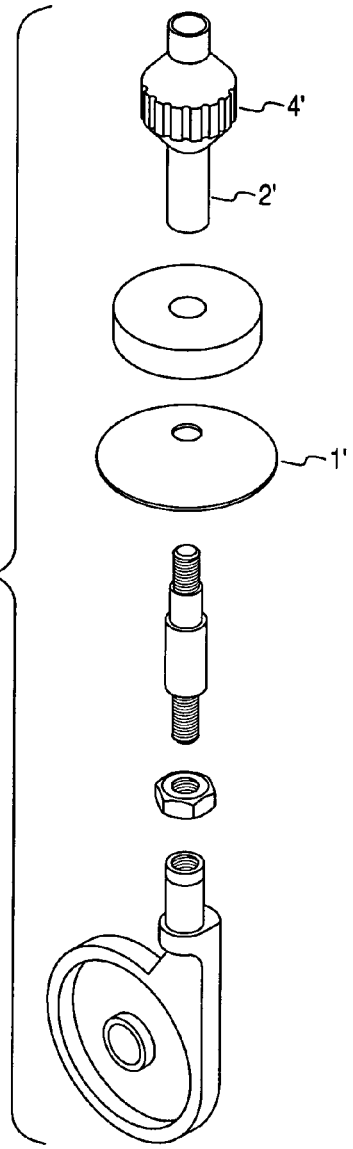
Fig. 2 Prior Art
FIG. 2 is a modification of conventional arrangement for a seat cup with an integrated wing nut and sleeve.
Figure 3:
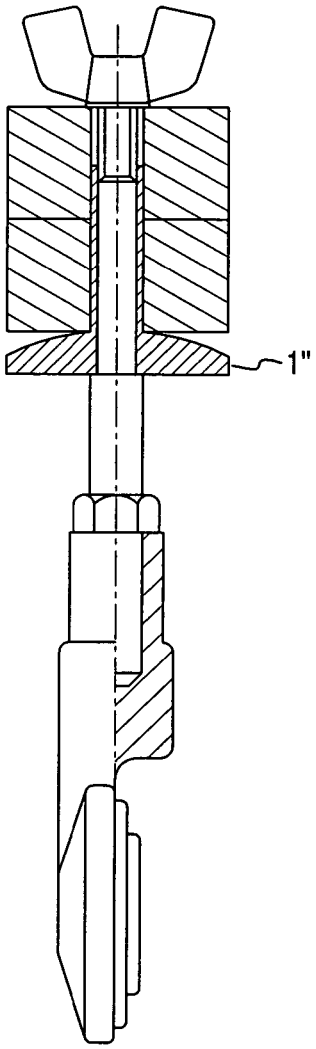
Fig. 3 Prior Art
FIG. 3 is a conventional arrangement for a seat cup with an integrated sleeve.
Figure 4:
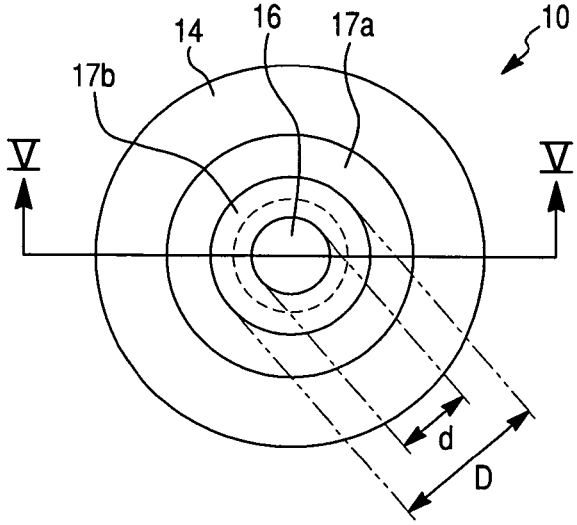
FIG. 4 is is a top view of the reversible seat cup of this invention.
Figure 5:
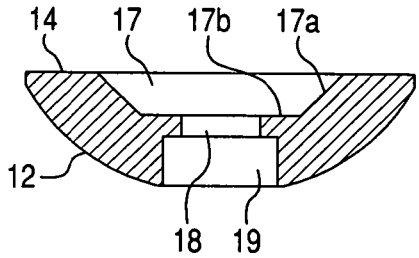
FIG. 5 is a cross sectional view of the reversible seat cup of FIG. 4 as viewed along section line V—V of FIG. 4.

FIGS. 4 and 5 show the reversible seat cup of this invention which allows free floating or fixed positioning of the seat cup, depending on application. The reversible seat cup 10 is a washer-like rounded plastic or metal disc or cup. The preferred material is plastic or other polymeric material capable of being molded, extruded or cast into various shapes.

The reversible seat cup 10 has a convex or dome-shaped side 12 and a flat side 14 with a central aperture 16 extending therebetween. The central aperture 16 is defined by a first enlarged open portion 17, a second central narrow portion 18 and a third open portion 19. The first enlarged open portion 17 is defined by a sloping surface 17*a* and a flat bottom surface 17*b*. The third open portion has a single diameter which is larger than the diameter 'D' of the second central portion 18 but smaller than the diameter 'd' defined by the flat bottom surface 17*b*.

Figure 6:
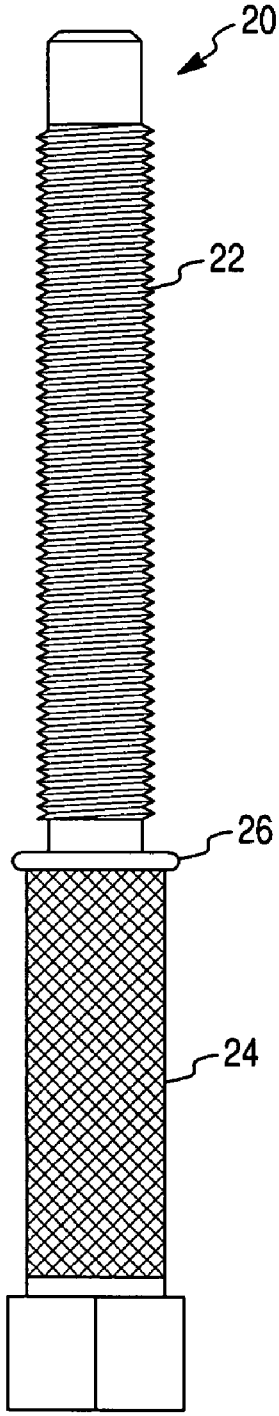
FIG. 6 shows a threaded post used in conjunction with the reversible seat cup of this invention.
Figure 7:
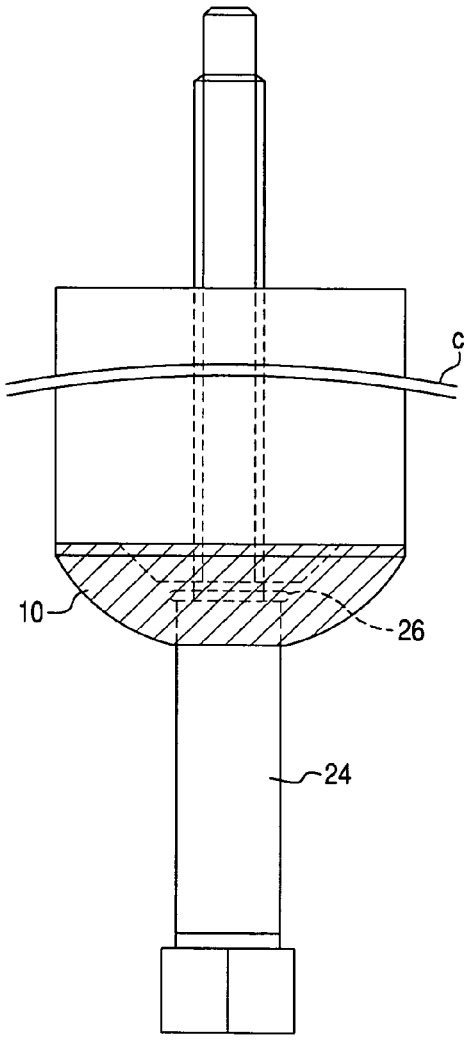
FIG. 7 shows the reversible seat cup positioned with the convex side positioned downward and locked firmly to the threaded post.

With reference to FIG. 6, the threaded post 20 has a threaded portion 22 and a non-threaded portion 24. A rubber o-ring 26 is disposed at the top of the non-threaded portion 24. For applications where the cymbal needs to be rigidly held, such as China cymbals, and/or minimal stand noise is essential, such as symphonic performances or studio applications, the reversible seat cup 10 can be positioned with the convex side 12 positioned downward and "locked" firmly to the threaded post 20 due to the matching diameters of the third open portion 19 and the non-threaded portion 24. FIG. 7 shows the reversible seat cup positioned with the convex side in a downward position. The rubber O-ring 26 on the threaded post 20 fits into the seat cup 10 to provide secure attachment and silent action.

Figure 8:
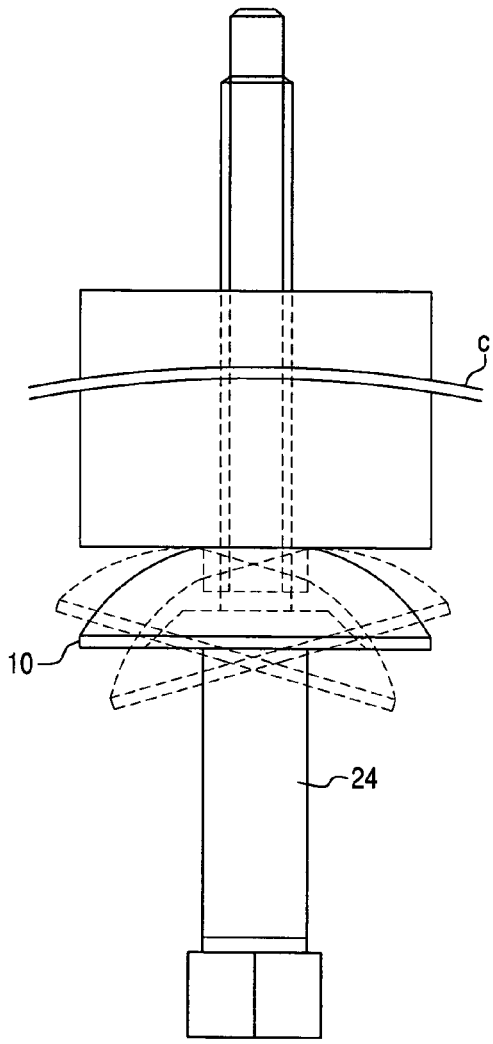
FIG. 8 shows the reversible seat cup positioned with the convex side positioned upward to provide a freedom of movement for the cymbal.

For applications where the cymbal, such as crash cymbals, needs freedom of movement, the reversible seat cup 10 can be positioned with the convex side 12 positioned upward as shown in FIG. 8. The cavity defined by the first enlarged open portion 17, which is opposite the convex side 12, allows the seat cup 10 to float on the rubber O-ring 26 for optimal cymbal sound. The plastic-type material of the seat cup 10 and the rubber O-ring 26 provides silent action and freedom of motion.

From the foregoing, it is clear that the present invention provides a one-piece reversible cymbal seat cup that uniquely combines the advantages of both the selective playing mode option of the standard arrangements and a greater convenience over the seat cups disclosed in the prior art.

While the foregoing invention has been shown and described with reference to a preferred embodiment, it will be understood by those of skill in the art that various changes in form and detail may be made therein without departing from the spirit and scope of the present invention.

What is claimed is:

1. A seat cup assembly for a percussion instrument, comprising a seat cup member having disk-shaped configuration and a first and second opposite side, said seat cup member having an aperture passing through a central portion, said aperture having a first portion defining a first diameter on said first side and a second portion defining a second diameter on said second opposite side, wherein the reversible seat cup is adapted to provide a first free floating arrangement whereby said seat cup is adapted to pivot relative to a threaded support post, and a second fixed positioning arrangement whereby said seat cup is prevented from pivoting relative to said threaded support post.

2. The seat cup assembly of claim 1, wherein said first side has a convex shape.

3. The seat cup assembly of claim 1, wherein said second side has a flat planar shape.

4. The seat cup assembly of claim 1, wherein said first portion defines a constant dimension for said first diameter.

5. The seat cup assembly of claim 1, wherein said second diamter is larger than said first diameter.

6. The seat cup assembly of claim 1, wherein said second portion defines an increasing dimension for said second diameter, said second diameter decreasing in a direction approaching said first portion.

7. The seat cup assembly of claim 1, further comprising an intermediate portion between said first portion and said second portion, said intermediate portion having a third diameter smaller than said first and second diameters.

8. The seat cup assembly of claim 1, wherein said seat cup member is circular in shape.

9. The seat cup assembly of claim 1, wherein said seat cup member is a single homogenously formed unitary member.

10. A combination seat cup assembly and support post for a percussion instrument, comprising:

a support port having a first length with a first diameter and a second length with a second diameter larger than said first diameter;

a seat cup member having disk-shaped configuration and a first side and second side, said seat cup member having an aperture passing through a central portion, said aperture having a first portion defining a first open diameter on said first side and a second portion defining a second open diameter on said second opposite side, wherein said first open diameter substantially matches said second diameter of said support post to lock said seat cup member against pivoting movement when a top of said second length is received in said first portion, and wherein said second open diameter is substantially larger than said second diameter of said support post to provide a free floating arrangement whereby said seat cup is adapted to pivot relative to said support post.

11. A combination seat cup assembly and support post of claim 10, wherein said first side has a convex shape.

12. A combination seat cup assembly and support post of claim 10, wherein said second side has a flat planar shape.

13. A combination seat cup assembly and support post of claim 10, wherein said first portion defines a constant dimension for said first open diameter.

14. A combination seat cup assembly and support post of claim 10, wherein said second open diameter is larger than said first open diameter.

15. A combination seat cup assembly and support post of claim 10, wherein said second portion defines an increasing dimension for said second open diameter, said second open diameter decreasing in a direction approaching said first portion.

16. A combination seat cup assembly and support post of claim 10, further comprising an intermediate portion between said first portion and said second portion, said intermediate portion having a third diameter smaller than said first and second open diameters.

* * * * *